US010387985B2

(12) United States Patent
Uselton

(10) Patent No.: US 10,387,985 B2
(45) Date of Patent: Aug. 20, 2019

(54) DISTRIBUTED RENEWABLE ENERGY METERING

(75) Inventor: Robert B. Uselton, Plano, TX (US)

(73) Assignee: Lennox Industries, Inc., Richardson, TX (US)

( * ) Notice: Subject to any disclaimer, the term of this patent is extended or adjusted under 35 U.S.C. 154(b) by 1113 days.

(21) Appl. No.: 13/269,246

(22) Filed: Oct. 7, 2011

(65) Prior Publication Data

US 2013/0090935 A1 Apr. 11, 2013

(51) Int. Cl.
*G06Q 99/00* (2006.01)
*G06Q 50/06* (2012.01)

(52) U.S. Cl.
CPC ..... *G06Q 99/00* (2013.01); *G06Q 50/06* (2013.01); *Y04S 10/60* (2013.01)

(58) Field of Classification Search
CPC ..... G01R 31/42; Y04S 30/14; G06Q 50/06
USPC ..... 702/60, 61, 62, 85, 108, 127; 705/1.1
See application file for complete search history.

(56) References Cited

U.S. PATENT DOCUMENTS

| | | | | |
|---|---|---|---|---|
| 4,610,700 | A * | 9/1986 | Miller et al. | 95/117 |
| 2003/0167679 | A1* | 9/2003 | Jordan | 44/324 |
| 2010/0293045 | A1* | 11/2010 | Burns et al. | 705/14.11 |
| 2011/0202191 | A1* | 8/2011 | Larsson et al. | 700/287 |
| 2012/0109393 | A1* | 5/2012 | Kosaka et al. | 700/291 |

* cited by examiner

*Primary Examiner* — Manuel A Rivera Vargas
*Assistant Examiner* — Yaritza H Perez Bermudez
(74) *Attorney, Agent, or Firm* — Baker Botts L.L.P.

(57) ABSTRACT

A distributed renewable energy system includes a renewable energy generating module having an array of renewable energy generators connected to a population of distributed power inverters. The distributed renewable energy system also includes a distributed energy metering module having a data aggregating unit that receives output energy data from the population of distributed power inverters and a data processing unit that calculates a revenue grade output energy from the output energy data based on a tolerance probability characteristic of the output energy data. The distributed renewable energy system additionally includes a distributed energy reporting module that reports the revenue grade output energy. A method of measuring distributed renewable energy is also provided.

21 Claims, 5 Drawing Sheets

DISTRIBUTED RENEWABLE ENERGY METERING

TECHNICAL FIELD

This application is directed, in general, to renewable energy measurement and, more specifically, to a distributed energy metering module, a method of measuring distributed renewable energy and a distributed renewable energy system.

BACKGROUND

Mainstream media has extensively covered efforts to reduce reliance on fossil and nuclear fuels in favor of so-called renewable energy, chief among these being solar and wind energy. Residential and business electric power customers have taken steps to reduce their dependence on the commercial electric power distribution network (commonly called "the grid") and the electric power utilities that sell electric power through it by installing renewable energy systems.

Conventional renewable energy systems typically connect straight back to the electrical distribution panel near the electrical service entrance and kilowatt-hr meter. For these conventional installations, a Renewable Energy Credit (REC) meter (i.e., a revenue grade meter) is installed and captures the amount of renewable energy generated, where revenue grade metering of an energy source provides an energy metering accuracy of at least 0.2 percent. The two meters can easily be read at the same time since they are co-located.

For a commercial business, for example, the renewable energy system may be located on the roof of a large building that is distant from the commercial kilowatt-hr meter. Additionally, the commercial renewable energy installation may be somewhat distributed requiring many separate REC meters where their location would not be convenient for reading.

Improvements in these areas would prove beneficial to the art.

SUMMARY

Embodiments of the present disclosure provide a distributed energy metering module, a method of measuring distributed renewable energy and a distributed renewable energy system.

In one embodiment, the distributed energy metering module includes a data aggregating unit configured to receive output energy data from a population of distributed power inverters connected to an array of renewable energy generators. Additionally, the distributed energy metering module includes a data processing unit configured to calculate a revenue grade output energy for the population of distributed power inverters based on a tolerance probability characteristic of the output energy data.

In another aspect, the method of measuring distributed renewable energy includes receiving output energy data from a population of distributed power inverters connected to an array of renewable energy generators and calculating a revenue grade output energy for the population of distributed power inverters based on a tolerance probability characteristic of the output energy data. The method of measuring distributed renewable energy also includes reporting the revenue grade output energy.

In yet another aspect, the distributed renewable energy system includes a renewable energy generating module having an array of renewable energy generators connected to a population of distributed power inverters. The distributed renewable energy system also includes a distributed energy metering module having a data aggregating unit that receives output energy data from the population of distributed power inverters and a data processing unit that calculates a revenue grade output energy from the output energy data based on a tolerance probability characteristic of the output energy data. The distributed renewable energy system additionally includes a distributed energy reporting module that reports the revenue grade output energy.

The foregoing has outlined preferred and alternative features of the present disclosure so that those skilled in the art may better understand the detailed description of the disclosure that follows. Additional features of the disclosure will be described hereinafter that form the subject of the claims of the disclosure. Those skilled in the art will appreciate that they can readily use the disclosed conception and specific embodiment as a basis for designing or modifying other structures for carrying out the same purposes of the present disclosure.

BRIEF DESCRIPTION

Reference is now made to the following descriptions taken in conjunction with the accompanying drawings, in which.

Figure 5:
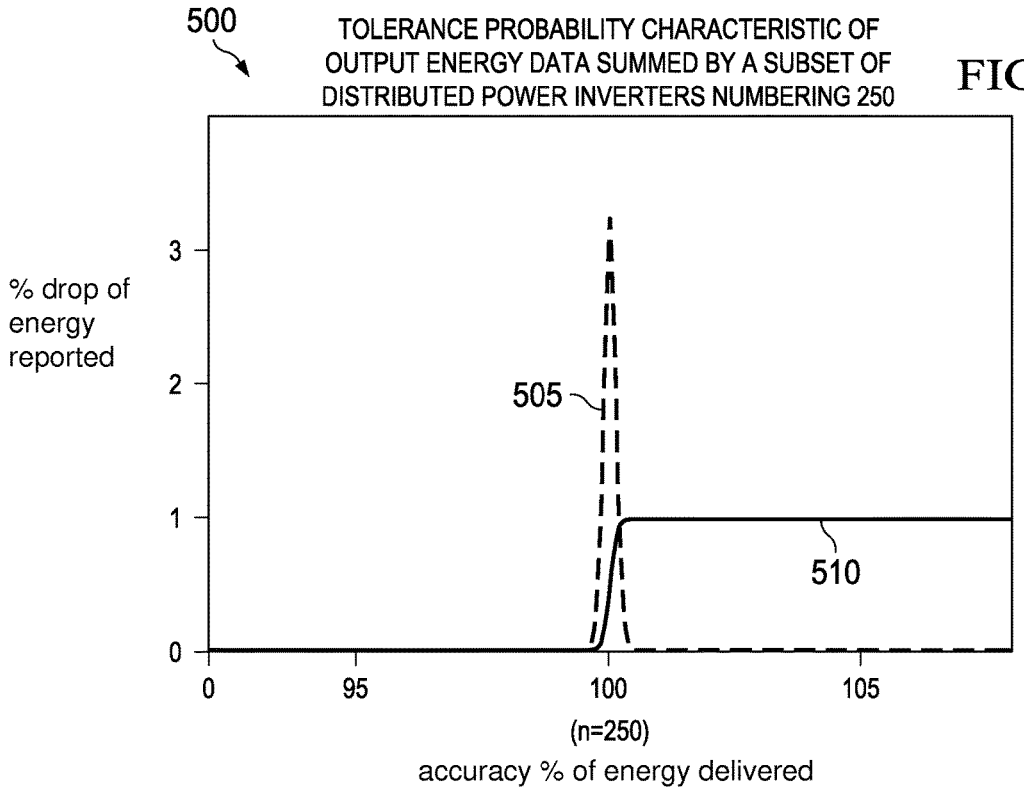
Figure 6:
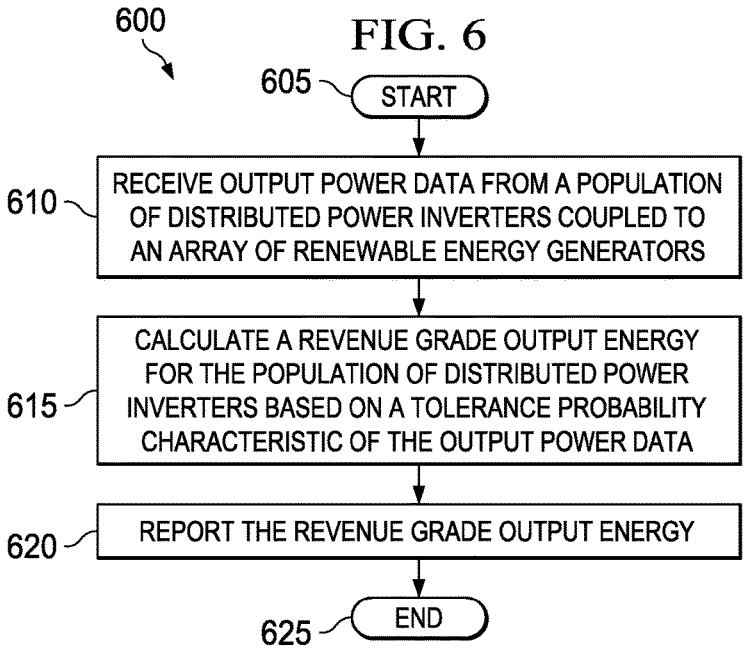

FIG. 5 illustrates graphs corresponding to another example of a tolerance probability characteristic of output energy data as may be employed in calculating revenue grade output energy for a larger population of distributed power inverters; and FIG. 6 illustrates a flow diagram of an embodiment of a method of measuring renewable electrical energy carried out according to the principles of the present disclosure.

DETAILED DESCRIPTION

Embodiments of the present disclosure provide a revenue grade renewable energy metering capability for a population or collection of distributed power inverters that generate renewable energy output power and provide corresponding output energy data thereby qualifying for electric utility Performance Based Incentives (PBIs). This revenue grade metering eliminates a need for a separate, dedicated, high-accuracy REC kilowatt-hour meter and may be reported in several formats to onsite and offsite locations.

Figure 1:
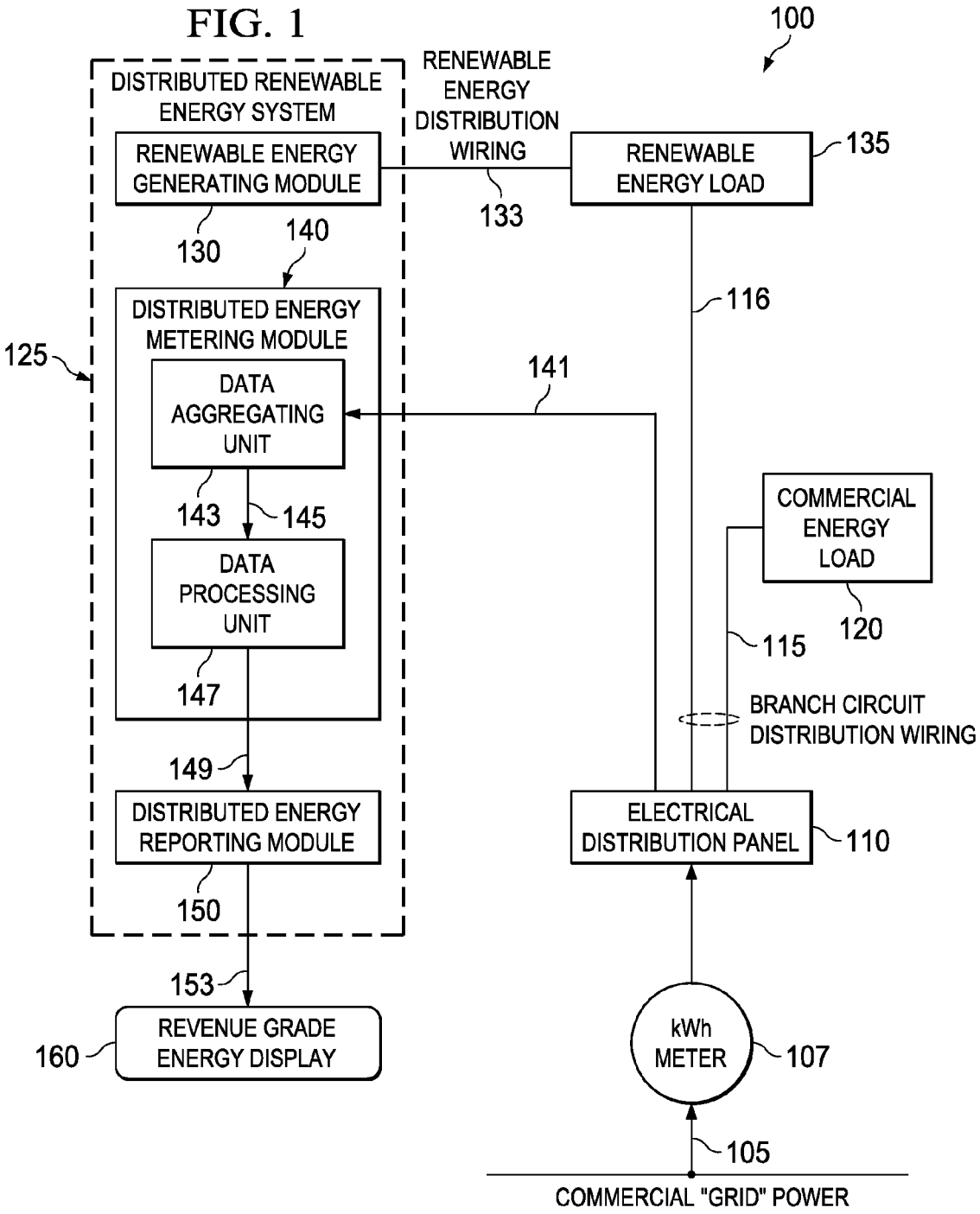
FIG. 1 illustrates a block diagram of an embodiment of a hybrid energy generation and distribution system constructed according to the principles of the present disclosure.

FIG. 1 illustrates a block diagram of an embodiment of a hybrid energy generation and distribution system, generally designated 100, constructed according to the principles of the present disclosure. The hybrid energy generation and distribution system 100 is representative of an industrial, commercial or residential installation and includes a commercial "grid" electrical service entrance 105, a commercial kilowatt-hour (kWh) meter 107, an electrical distribution panel 110, branch circuit distribution wiring 115, 116 and a commercial energy load 120. The hybrid energy generation and distribution system 100 also includes a distributed renewable energy system 125, renewable energy distribution wiring 133 and a renewable energy load 135.

The commercial kWh meter 107 is connected to the commercial electrical service entrance 105 and meters the commercial energy used by the hybrid energy generation and distribution system 100. The electrical distribution panel 110 is connected to the commercial kWh meter 107 and provides a connection point for the branch circuit distribution wiring 115 that supplies commercial power to the commercial energy load 120. The commercial energy load 120 may be representative of a single load or a plurality of loads.

The distributed renewable energy system 125 includes a renewable energy generating module 130, a distributed energy metering module 140 and a distributed energy reporting module 150. The renewable energy generating module 130 includes an array of renewable energy generators connected to a population of distributed power inverters that provide renewable energy to the renewable energy load 135 through the renewable energy distribution wiring 133.

In one example, the array of renewable energy generators includes solar power photovoltaic cells connected to the population of distributed power inverters. In another example, the array of renewable energy generators includes wind turbines connected to the population of distributed power inverters. Other present or future examples of renewable energy generators may also be employed.

The renewable energy load 135 may also be representative of a single load or a plurality of loads. Additionally, the renewable energy generators connected to the population of distributed power inverters may include or consist of pairings of one individual renewable energy generator to one individual power inverter wherein these pairings have outputs that are parallel-connected to the renewable energy distribution wiring 133. These inverters having parallel-connected outputs are generally "utility-interactive" inverters (e.g., conform to the IEEE standard 1547) and have the ability to synchronize their output power with an electric grid power.

Additionally, the branch circuit distribution wiring 116 is connected to the renewable energy load 135 to supplement the renewable energy provided, when needed. Alternately, the branch circuit distribution wiring 116 may receive energy from the renewable energy generating module 130 when its output exceeds renewable energy load requirements of the renewable energy load 135.

The distributed energy metering module 140 includes a data aggregating unit 143 connected to receive output energy data from the population of distributed power inverters. The distributed energy metering module 140 also includes a data processing unit 147 connected to calculate a revenue grade output energy for the population of distributed power inverters based on a tolerance probability characteristic of the output energy data.

The data processing unit 147 may be preloaded with or have access to the tolerance probability characteristic information (e.g., accuracy mean and standard deviation) from a large population of the distributed power inverters. In one embodiment, the large population of the distributed power inverters may include all power inverter production test data. Alternately, it may have available "birth certificate accuracy" information for each of the distributed power inverters being employed in a pertinent installation.

Using this information, the data processing unit 147 can make decisions about adjusting the reported total energy so as to always meet a certain probability (e.g., 95 percent) that the reported total energy is not more than 0.2 percent high and thus meet revenue grade metering accuracy requirements. The distributed energy reporting module 150 is connected to report the revenue grade output energy.

The data aggregating unit 143 receives output energy data from each of the population of distributed power inverters through an input power data connection 141. In the illustrated embodiment, the output energy data from each of the population of distributed power inverters is modulated onto the branch circuit distribution wiring 115, 116 as well as the renewable energy distribution wiring 133. The data aggregating unit 143 also provides aggregated output energy data to the data processing unit 147 through an aggregated data connection 145. Correspondingly, the data processing unit 147 provides values of calculated revenue grade output energy to the distributed energy reporting module 150 through an output energy connection 149.

In the illustrated embodiment, the input power data connection 141 is a wired connection to the branch circuit distribution wiring 115, 116. In an alternate embodiment, the input power data connection 141 may be a wireless connection to the renewable energy distribution wiring 133. In one embodiment, the data aggregating unit 143 and the data processing unit 147 are located within a same installation site and the aggregated data connection 145 may be a wired or a wireless connection between the two. In another embodiment, the data aggregating unit 143 and the data processing unit 147 are located within separate installation sites, and the aggregated data connection 145 may be a wireless or a communications network connection (e.g., an Internet connection) that provides the aggregated output energy data to a remote data processing unit 147.

Analogously, the distributed energy reporting module 150 may be co-located with or remotely located from the data processing unit 147. For an installation where the data processing unit 147 and the distributed energy reporting module 150 are co-located, the output energy connection 149 may be a wired or a wireless connection. Alternately, for an installation where the data processing unit 147 and the distributed energy reporting module 150 are located in different installation sites, the output energy connection 149 may be a wireless or a communications network connection.

The distributed energy reporting module 150 reports values of the calculated revenue grade output energy employing different reporting formats through a revenue grade energy reporting connection 153. Examples of these reporting formats include a liquid crystal display (e.g., a cell phone, a computer monitor or a dedicated device customized for this application) and a database. In the illustrated embodiment, the revenue grade energy reporting connection 153 is a wired connection to a co-located revenue grade energy display 160.

Alternately, the revenue grade energy connection 153 may employ a wireless connection for this display embodiment or for an embodiment where the distributed energy reporting module 150 and the revenue grade energy display 160 are not co-located. Additionally, the revenue grade energy reporting connection 153 may employ a communications network connection, especially for reporting a database.

Figure 2A:
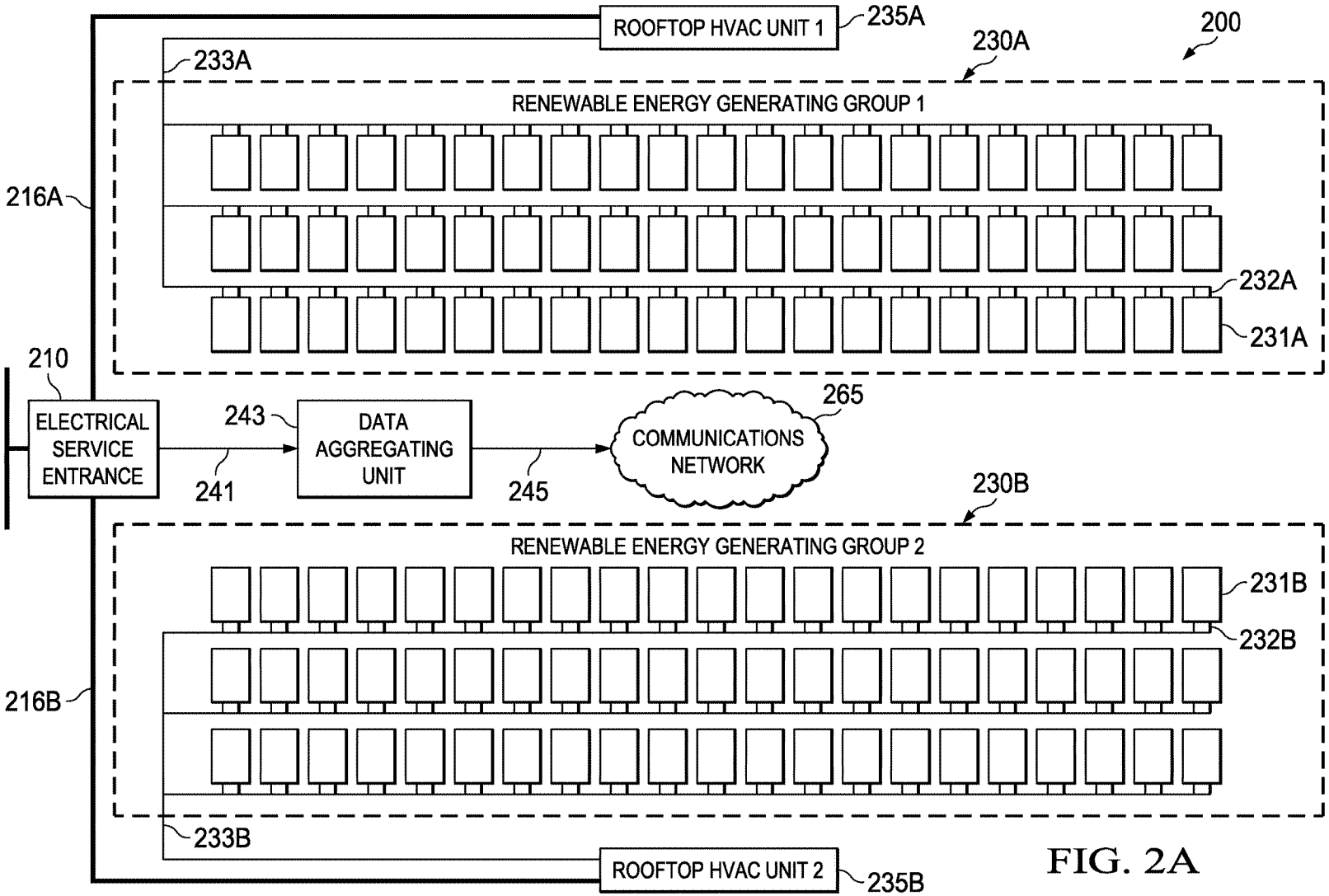
FIG. 2A illustrates a diagram of an example of an onsite portion of a hybrid energy generation and distribution system employing heating, ventilation and air conditioning (HVAC) rooftop units as a renewable energy load.

FIG. 2A illustrates a diagram of an example of an onsite portion of a hybrid energy generation and distribution system, generally designated 200, employing heating, ventilation and air conditioning (HVAC) rooftop units as a renewable energy load. In the illustrated embodiment, the onsite portion of the hybrid energy generation and distribution system 200 includes an electrical service entrance 210 that provides branch circuit distribution wiring 216A, 216B. The hybrid energy generation and distribution system 200 also includes a renewable energy generating module organized into first and second renewable energy generating groups 230A, 230B respectively connected to first and second HVAC rooftop units 235A, 235B and a data aggregating unit 243 connected to a communications network 265.

Each of the first and second renewable energy generating groups 230A, 230B includes a plurality of pairings of one individual solar module connected to one individual distributed power inverter wherein solar module and distributed power inverter pairs 231A:232A and 231B:232B are typical. These pairings constitute a solar power array of photovoltaic cells connected to a population of distributed power inverters having outputs that are parallel-connected to renewable energy distribution wiring 233A, 233B, respectively. The branch circuit distribution wiring 216A and the renewable energy distribution wiring 233A are connected to the first HVAC rooftop unit 235A. Correspondingly, the branch circuit distribution wiring 216B and the renewable energy distribution wiring 233B are connected to the second HVAC rooftop unit 235B.

The data aggregating unit 243 employs an input power data connection 241 coupled to the renewable energy distribution wiring 233A, 233B through the branch circuit distribution wiring 216A, 216B proximate the electrical service entrance 210 to receive output energy data from the population of distributed power inverters. Output power data from each of the population of distributed power inverters is superimposed onto the branch circuit distribution wiring 216A, 216B and the renewable energy distribution wiring 233A, 233B. The data aggregating unit 243 provides aggregated output energy data to the communications network 265 through an aggregated data connection 245.

Figure 2B:
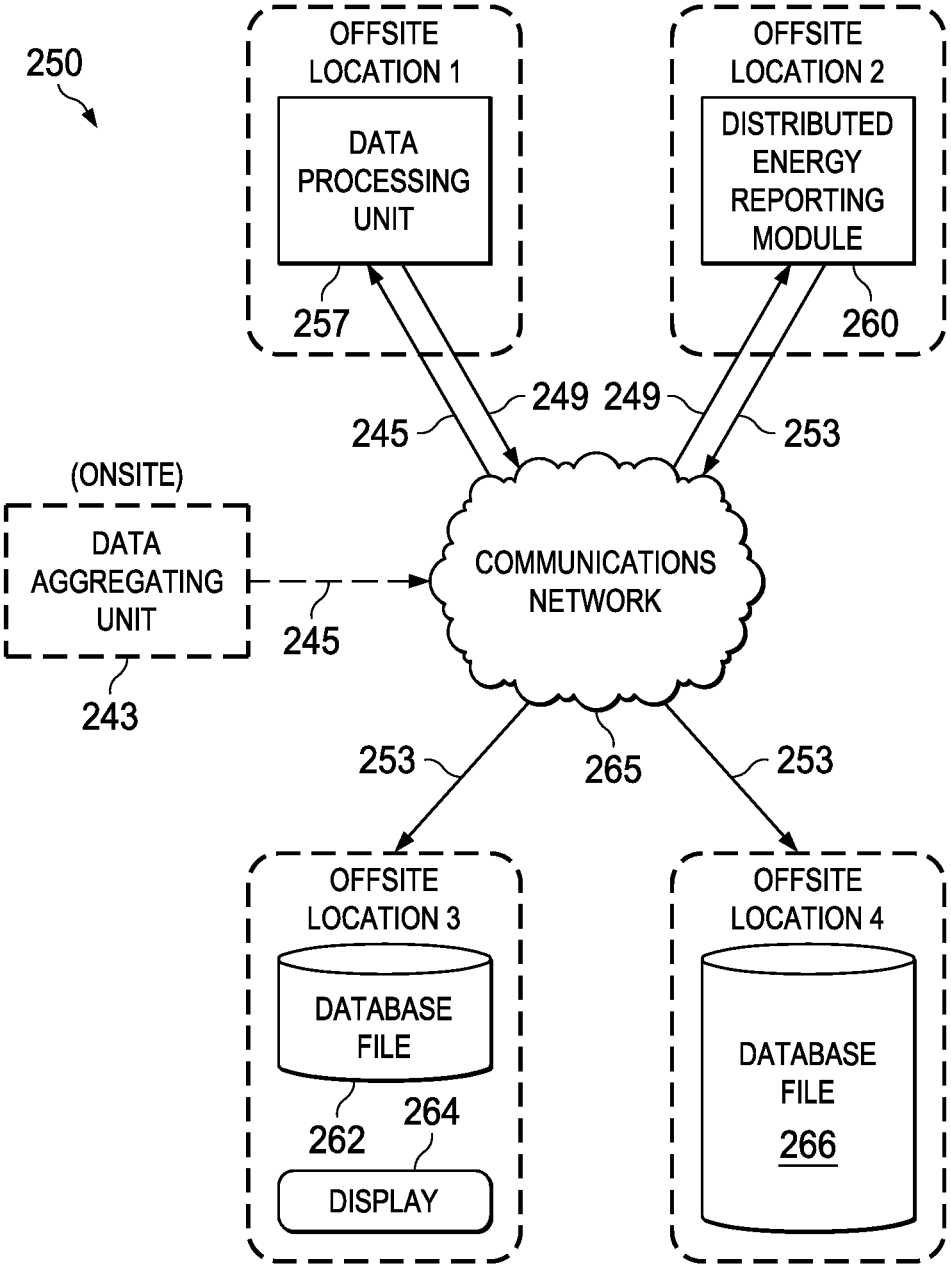
FIG. 2B illustrates a diagram of an example of an offsite portion of the hybrid energy generation and distribution system of FIG. 2A constructed according to the principles of the present disclosure.

FIG. 2B illustrates a diagram of an example of an offsite portion of the hybrid energy generation and distribution system of FIG. 2A, generally designated 250, constructed according to the principles of the present disclosure. The hybrid energy generation and distribution system 250 includes a data processing unit 257 at a first offsite location and a distributed energy reporting module 260 at a second offsite location.

The data processing unit 257 receives aggregated output energy data through the aggregated data connection 245 employing the communications network 265 and provides values of calculated revenue grade output energy to the distributed energy reporting module 260 through an output energy connection 249 that also employs the communications network 265.

The distributed energy reporting module 260 reports values of the calculated revenue grade output energy employing different reporting formats through a revenue grade energy reporting connection 253 and the communications network 265 to third and fourth offsite locations, as shown. A database file 262 and information for a computer display 264 are provided to the third offsite location, and another database file 266 is provided to the fourth offsite location. Although not specifically shown, the revenue grade energy reporting connection 253 and the communications network 265 may also provide a revenue grade energy display to an onsite location proximate a commercial kWh meter for the onsite location.

The first offsite location may be a service provider that calculates the revenue grade output energy from the aggregated output energy data. The second offsite location may be a maintenance and engineering group having responsibility for maintaining optimum performance of the system. The third offsite location may be an accounting department that tracks revenue grade energy reimbursements, and the fourth offsite location may be a utility company that provides the revenue grade energy reimbursements or discounts (e.g., PBIs) or may provide automated meter reading services.

Figure 3:
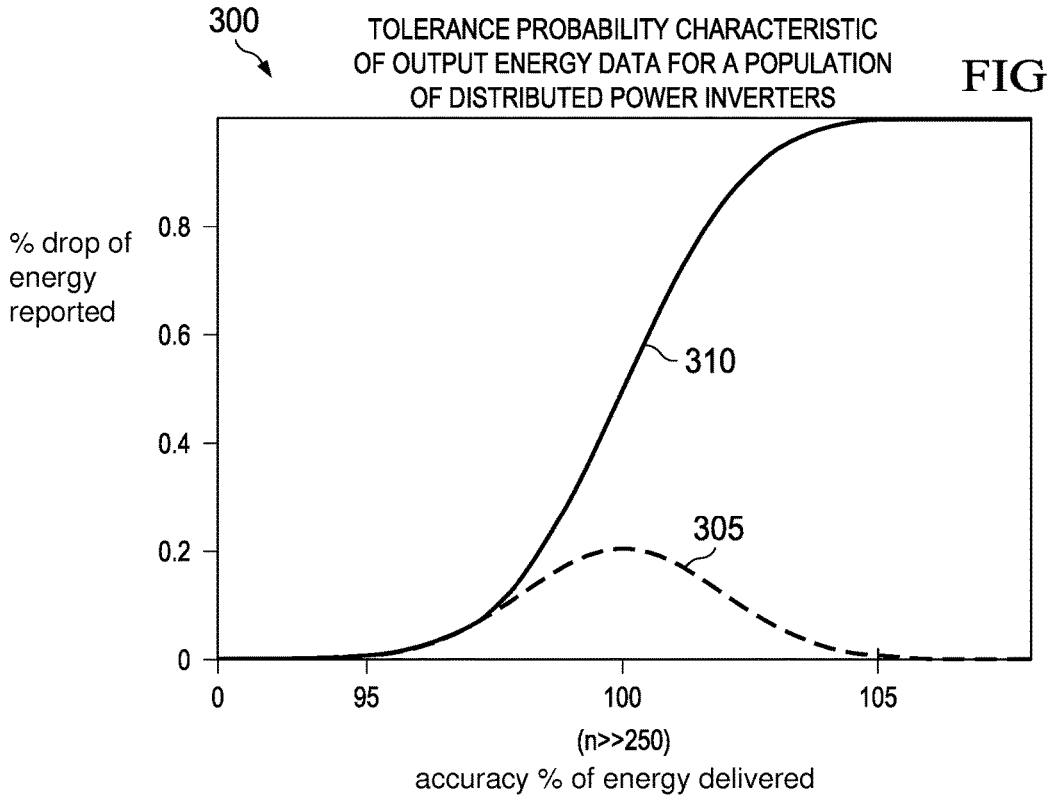
FIG. 3 illustrates graphs corresponding to an example of a tolerance probability characteristic of output energy data as may be employed in calculating revenue grade output energy for a population of distributed power inverters.

FIG. 3 illustrates graphs corresponding to an example of a tolerance probability characteristic of output energy data, generally designated 300, as may be employed in calculating revenue grade output energy for a population of distributed power inverters. The tolerance probability characteristic 300 provides a characterization of individual distributed power inverters making up a population of distributed power inverters.

The tolerance probability characteristic 300 includes a tolerance probability density graph 305 corresponding to a probability distribution for an accuracy (x) of a population of inverters if the accuracy is normally distributed, and 95 percent of the inverters fall within ±5 percent of a nominal 100 percent accuracy (a standard deviation $\sigma$=1.9455). The tolerance probability characteristic 300 also includes a tolerance probability distribution graph 310 corresponding to a cumulative probability distribution for the same population.

These graphs correspond to a ±5 percent tolerance (i.e., accuracy) distribution of output energy data for a population of distributed power inverters. Of course, selection of the ±5 percent tolerance is exemplary and other percentage tolerance distributions may be employed. These characteristics are determined by setting a mean $\mu$ and a standard deviation to the following values, as indicated above. That is $$\mu:=100 \text{ and } \sigma:=1.9455, \tag{1}$$

for plotting the probabilities versus x.

Then, 99 percent of the output energy data for the population of distributed power inverters are within ±2.56 times the standard deviation $\sigma$ around the mean $\mu$.

Figure 4:
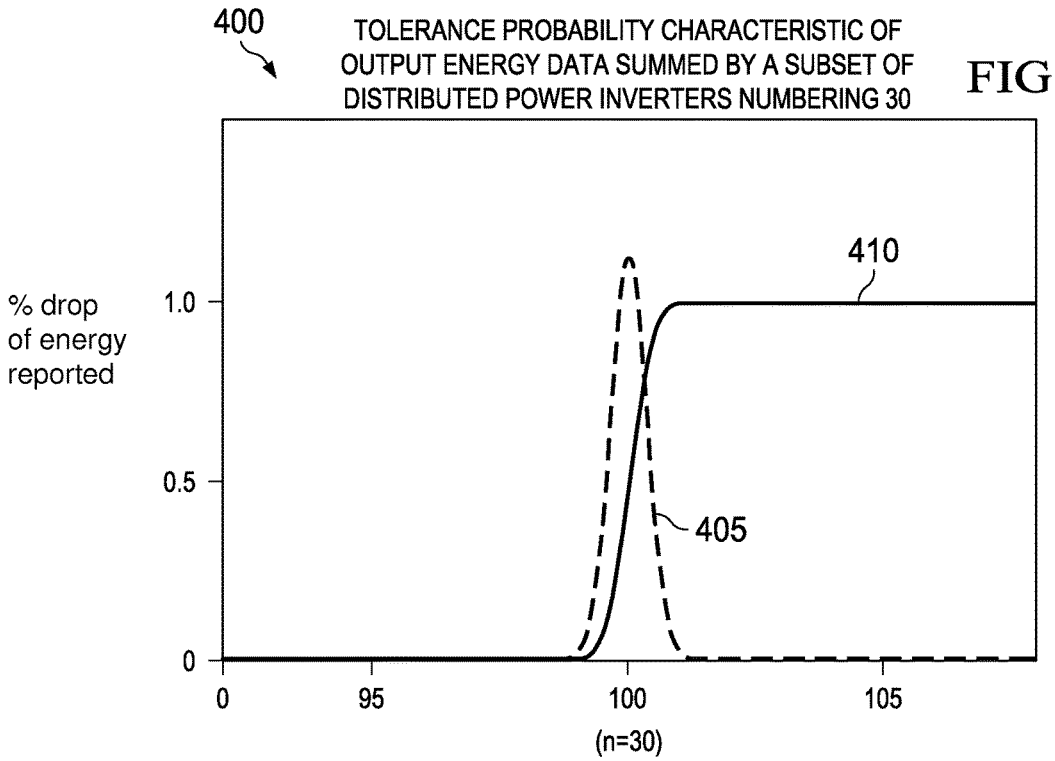
FIG. 4 illustrates graphs corresponding to another example of a tolerance probability characteristic of output energy data as may be employed in calculating revenue grade output energy for a subset of distributed power inverters.

FIG. 4 illustrates graphs corresponding to another example of a tolerance probability characteristic of output energy data, generally designated 400, as may be employed in calculating revenue grade output energy for a subset (i.e., a sample set) of distributed power inverters. That is, the tolerance probability characteristic 400 provides a characterization of different subsets of 30 individual distributed power inverters from a population of distributed power inverters.

The tolerance probability characteristic 400 includes a tolerance probability density graph 405 corresponding to a probability distribution for different subsets of 30 individual distributed power inverters from the population of distributed power inverters. The subsets of a certain size are normally distributed and predictable, and a mean accuracy for the subsets converges on the mean accuracy of the population of distributed power inverters (e.g., the tolerance probability characteristic 300 above). The tolerance probability characteristic 400 also includes a tolerance probability distribution graph 410 corresponding to a cumulative probability distribution for the same sample sets.

The Central Limit Theorem for probability distributions indicates that for sample sets (subsets) that have at least 30 members taken from a large population, a mean ybar of the sample set will tend toward a mean μ of the large population. A standard deviation s of the sample set is equal to a standard deviation σ of the large population divided by the square root of the size of the sample set.

For a sample set size equal to 30 (n=30) distributed power inverters, which may be encountered in a small commercial building installation:

$$ybar = \mu = 100,\ \sigma = 1.9455 \tag{2}$$

and $$s := \frac{\sigma}{\sqrt{n}} = 0.355.$$

The tolerance probability characteristic 400 shows the distribution of means with sample set size of 30 distributed power inverters for a range of x.

The mean of the sample set represents the accuracy of the sum of the outputs (the accuracy of the group rather than accuracy of individual members) of this population of distributed power inverters. Additionally, the errors are evenly distributed on each side of the mean so they tend to cancel each other. Therefore, with ybar=100 and s=0355, a single-sided probability (sample set=30) is about 71 percent that the group will report energy use without exceeding a 100.2 percent revenue grade limit.

Additionally, for sample sets down to 30 distributed power inverters, a data processing unit in a distributed energy metering module may include a processing technique that automatically derates (i.e., under reports an energy value) a distributed power output appropriately and shifts the probability distribution to a more conservative value. In this case, under reporting energy by 0.5 percent brings the probability up significantly over 95 percent that a reported energy is not more than 100.2 percent of the actual energy delivered. It may be noted that for sample sizes that are smaller than 30, the Student's T probability distribution may be used instead of a "normal" distribution. Otherwise, the analysis follows a parallel approach.

FIG. 5 illustrates graphs corresponding to another example of a tolerance probability characteristic of output energy data, generally designated 500, as may be employed in calculating revenue grade output energy for a larger population of distributed power inverters. As with FIG. 4, the tolerance probability characteristic 500 provides a characterization of different subsets of 250 individual distributed power inverters from a population of distributed power inverters.

The tolerance probability characteristic 500 includes a tolerance probability density graph 505 corresponding to a probability distribution for different subsets of 250 individual distributed power inverters from the population of distributed power inverters. As before, the subsets of a certain size are normally distributed and predictable, and a mean accuracy for the subsets converges on the mean accuracy of the population of distributed power inverters. The tolerance probability characteristic 500 also includes a tolerance probability distribution graph 510 corresponding to a cumulative probability distribution for the same sample sets.

For larger populations of distributed power inverters, there is a sample size for which it is no longer necessary to derate (i.e., under report) the reported energy output to achieve a 95 percent probability that the system does not over report by more than the 0.2 percent. A sample size (subset) of around 250 distributed power inverters meets this criterion, which may be employed for a large commercial building installation.

The tolerance probability characteristic 500 shows the distribution of means with sample set size of 250 distributed power inverters. That is, let sample size n=250. Then, $$ybar := \mu = 100, \tag{3}$$

$$\sigma = 1.9455, \tag{4}$$

$$s : \frac{\sigma}{\sqrt{n}} \tag{5}$$

and $$s = 0.123$$

resulting in a very small standard deviation in the mean accuracy of the system. At a sample size of 250, the probability of meeting the revenue grade requirement approaches 95 percent.

Although the assumption was made in the preceding discussions that the accuracy distribution of the population of distributed power inverters is a normal distribution, this does not have to be the case. The mean of sample sets taken from a population will still be normally distributed even though the accuracy of the population may have some other distribution.

FIG. 6 illustrates a flow diagram of an embodiment of a method of measuring distributed renewable energy, generally designated 600, carried out according to the principles of the present disclosure. The method 600 starts in a step 605. Then, in a step 610, output energy data is received from a population of distributed power inverters connected to an array of renewable energy generators. A revenue grade output energy is calculated for the population of distributed power inverters based on a tolerance probability characteristic of the output energy data, in a step 615.

In one embodiment, the population of distributed power inverters provides power to a heating, ventilation or air conditioning (HVAC) load. Correspondingly, each of the population of distributed power inverters is connected to only one renewable energy generator, and the revenue grade output energy corresponds to a summation of the output energy data from each of the population of distributed power inverters. The tolerance probability characteristic of the output energy data corresponds to a summation of the output energy data having an accuracy that is normally distribution around a mean value.

In another embodiment, the tolerance probability characteristic of the output energy data corresponds to increasing a single-sided confidence level for an accuracy of the output energy data by under reporting the revenue grade output energy. In yet another embodiment, the tolerance probability characteristic of an accuracy of the output energy data corresponds to applying the Central Limit Theorem to predict a mean and standard deviation of the accuracy of the output energy data from 30 or more distributed power inverters. In still another embodiment, the tolerance probability characteristic of an accuracy of the output energy data corresponds to applying the Student's T probability distribution to predict a mean and standard deviation of the accuracy of the output energy data from less than 30 distributed power inverters.

In a further embodiment, the tolerance probability characteristic of the output energy data for a summation sample set size of at least 250 distributed power inverters corresponds to a probability distribution having about a 95 percent confidence level of not over reporting the revenue grade output energy by more that 0.2 percent based on 99 percent of the population of distributed power inverters having an accuracy of ±5 percent of nominal.

In an alternative embodiment, the revenue grade output energy is reported in a step 620. The revenue grade output energy is reported using a wired connection, a wireless connection or a communications network, and the revenue grade output energy is reported in a database format or as display information. The method 600 ends in a step 625.

While the method disclosed herein has been described and shown with reference to particular steps performed in a particular order, it will be understood that these steps may be combined, subdivided, or reordered to form an equivalent method without departing from the teachings of the present disclosure. Accordingly, unless specifically indicated herein, the order or the grouping of the steps is not a limitation of the present disclosure.

Those skilled in the art to which this application relates will appreciate that other and further additions, deletions, substitutions and modifications may be made to the described embodiments.

What is claimed is:

1. A distributed energy metering module, comprising;

a data aggregating unit configured to receive output energy data from a population of distributed power inverters connected to an array of renewable energy generators, the population of distributed power inverters comprising at least 30 distributed power inverters, the data aggregating unit employing an input power data connection coupled to the population of distributed power inverters through associated branch circuit distribution wiring of an electrical service entrance and corresponding renewable distribution energy wiring;

a data processing unit configured to calculate a revenue grade output energy for the population of distributed power inverters based on a tolerance probability characteristic of the output energy data; and a display unit operable to display the revenue grade output energy; and wherein the tolerance probability characteristic of the output energy data corresponds to applying the Central Limit Theorem to predict a mean and standard deviation of an accuracy of the output energy data from 30 or more of the distributed power inverters belonging to the population of distributed power inverters.

2. The module as recited in claim 1 wherein each of the population of distributed power inverters is connected to only one renewable energy generator.

3. The module as recited in claim 1 wherein the revenue grade output energy corresponds to a summation of the output energy data from each of the population of distributed power inverters.

4. A method of measuring distributed renewable energy, comprising:

receiving, at a processor, output energy data from a population of distributed power inverters connected to an array of renewable energy generators, the population of distributed power inverters comprising at least 30 distributed power inverters; and calculating, at a processor, a revenue grade output energy for the population of distributed power inverters based on a tolerance probability characteristic of the output energy data; and wherein the tolerance probability characteristic of the output energy data corresponds to applying the Central Limit Theorem to predict a mean and standard deviation of an accuracy of the output energy data from 30 or more of the distributed power inverters belonging to the population of distributed power inverters.

5. The method as recited in claim 4 wherein the population of distributed power inverters provides power to a heating, ventilation or air conditioning (HVAC) load.

6. The method as recited in claim 4 wherein each of the population of distributed power inverters is connected to only one renewable energy generator.

7. The method as recited in claim 4 wherein the revenue grade output energy corresponds to a summation of the output energy data from each of the population of distributed power inverters.

8. The method as recited in claim 4 further comprising reporting the revenue grade output energy.

9. The method as recited in claim 8 wherein the revenue grade output energy is reported using a wired connection, a wireless connection or a communications network.

10. The method as recited in claim 8 wherein the revenue grade output energy is reported in a database format or as display information.

11. The method of claim 4 wherein the output energy data received by the processor is received using an input power data connection coupled to the population of distributed power inverters through associated branch circuit distribution wiring of an electrical service entrance and corresponding renewable distribution energy wiring.

12. A distributed renewable energy system, comprising:

a renewable energy generating module including an array of renewable energy generators connected to a population of distributed power inverters, the population of distributed power inverters comprising at least 30 distributed power inverters; and a distributed energy metering module, including:

a data aggregating unit that receives output energy data from the population of distributed power inverters, and a data processing unit that calculates a revenue grade output energy from the output energy data based on a tolerance probability characteristic of the output energy data;

wherein the tolerance probability characteristic of the output energy data corresponds to applying the Student's T probability distribution to predict a mean and standard deviation of an accuracy of the output energy data from less than 30 of the distributed power inverters belonging to the population of distributed power inverters.

13. The system as recited in claim 12 wherein the population of distributed power inverters provides power to a heating, ventilation or air conditioning (HVAC) load.

14. The system as recited in claim 12 wherein each of the population of distributed power inverters is connected to only one renewable energy generator.

15. The system as recited in claim 12 wherein the revenue trade output energy corresponds to a summation of the output energy data from each of the population of distributed power inverters.

16. The system as recited in claim 13 further comprising a distributed energy reporting module that reports the revenue grade output energy.

17. The system as recited in claim 16 wherein the revenue grade output energy is reported using a wired connection, a wireless connection or a communications network connection.

18. The system as recited in claim 16 wherein the revenue grade output energy is reported in a database format or as display information.

19. The system of claim 12 wherein, the distributed energy meeting module receives output energy data by employing an input power data connection coupled to the population of distributed power inverters through associated branch circuit distribution wiring of an electrical service entrance and corresponding renewable distribution energy wiring.

20. A distributed renewable energy system, comprising:

a renewable energy generating module including an array of renewable energy generators connected to a population of distributed power inverters; and a distributed energy metering module, including:

a data aggregating unit that receives output energy data from the population of distributed power inverters, wherein the population of distributed power inverters comprises at least 250 distributed power inverters; and a data processing unit that calculates a revenue grade output energy from the output energy data based on a tolerance probability characteristic of the output energy data, wherein the data processing unit determines whether to derate the output energy data based on whether the tolerance probability characteristic of the output energy data meets an about 95 percent confidence level of not over reporting the revenue grade output energy by more than 0.2 percent;

wherein the distributed renewable energy system determines that the tolerance probability characteristic of the output energy data for a summation sample set meets the about 95 percent confidence level of not over reporting the revenue grade output energy by more than 0.2 percent based on 99 percent of the population of distributed power inverters having an accuracy of 5 percent of nominal and the summation sample set including at least 250 of the distributed power inverters belonging to the population of distributed power inverters.

21. The system of claim 20 wherein, the distributed energy meeting module receives output energy data by the data aggregating unit employing an input power data connection coupled to the population of distributed power inverters through associated branch circuit distribution wiring of an electrical service entrance and corresponding renewable distribution energy wiring.

* * * * *